US005457014A

United States Patent [19]

Zengerle et al.

[11] Patent Number: 5,457,014

[45] Date of Patent: Oct. 10, 1995

[54] PHOTOGRAPHIC COATING COMPOSITIONS AND PHOTOGRAPHIC ELEMENTS MADE THEREFROM

[75] Inventors: Paul L. Zengerle; Glenn M. Brown; John B. Rieger, all of Rochester, N.Y.

[73] Assignee: Eastman Kodak Company, Rochester, N.Y.

[21] Appl. No.: 245,725

[22] Filed: May 18, 1994

Related U.S. Application Data

[62] Division of Ser. No. 9,906, Jan. 26, 1993, Pat. No. 5,360, 702.

[51] Int. Cl.[6] ..... G03C 1/46

[52] U.S. Cl. ..... 430/505; 430/507; 430/522; 430/517; 430/551; 430/546; 430/566; 430/214

[58] Field of Search ..... 430/505, 507, 430/522, 517, 551, 546, 566, 214

[56] References Cited

U.S. PATENT DOCUMENTS

| | | | |
|---|---|---|---|
| 3,661,899 | 5/1972 | Lange et al. | 260/207.1 |
| 3,933,501 | 1/1976 | Cameron et al. | 430/504 |
| 4,181,527 | 1/1990 | Toda et al. | 430/543 |
| 4,266,019 | 5/1981 | Kobayashi et al. | 430/551 |
| 4,366,236 | 12/1982 | Takahashi et al. | 430/505 |
| 4,407,940 | 10/1983 | Nakamura et al. | 430/546 |
| 4,447,523 | 5/1984 | Ross et al. | 430/505 |
| 4,684,606 | 8/1987 | Krishnamurthy | 430/546 |
| 4,770,984 | 9/1988 | Ailliet et al. | 430/505 |
| 4,794,072 | 12/1988 | Goddard | 430/546 |
| 4,818,659 | 4/1989 | Takabashi et al. | 430/264 |
| 4,855,220 | 8/1989 | Szajewski | 430/505 |
| 4,900,653 | 2/1990 | Factor et al. | 430/522 |
| 4,923,787 | 5/1990 | Harder | 430/264 |
| 4,923,788 | 5/1990 | Shuttleworth et al. | 430/522 |
| 4,925,832 | 5/1990 | Hall et al. | 430/264 |
| 4,927,744 | 5/1990 | Henzel et al. | 430/566 |
| 4,940,654 | 7/1990 | Diehl et al. | 430/522 |
| 4,948,718 | 8/1980 | Factor et al. | 430/522 |
| 4,950,586 | 8/1990 | Diehl et al. | 430/507 |
| 4,988,611 | 1/1991 | Anderson et al. | 430/494 |
| 4,994,356 | 2/1991 | Diehl et al. | 430/522 |
| 5,300,394 | 4/1994 | Miller et al. | 430/551 |

FOREIGN PATENT DOCUMENTS

| | | |
|---|---|---|
| 541873 | 6/1957 | Canada . |
| 53369 | 1/1967 | Germany . |
| JO 2124-558-A | 11/1988 | Japan . |

*Primary Examiner*—Thomas R. Neville
*Attorney, Agent, or Firm*—Andrew J. Anderson

[57] ABSTRACT

Melt crystallization of a photographic composition containing dispersed particles of a filter dye and dispersed particles of oxidized developer scavenger, in particular a hydrazide or a disulfonamidophenol oxidized developer scavenger, is inhibited by dispersing the oxidized developer scavenger in the composition in the form of particles comprising the oxidized developer scavenger dispersed or dissolved in an organic solvent selected such that the following relationship is satisfied:

$$6.65+10.0\ A-1.53\ B+0.11\ B^2-0.99\ AB \leqq 4.0$$

wherein A is the weight ratio of organic solvent to oxidized developer scavenger; and B is the log P of the organic solvent.

14 Claims, No Drawings

PHOTOGRAPHIC COATING COMPOSITIONS AND PHOTOGRAPHIC ELEMENTS MADE THEREFROM

This is a Divisional of application Ser. No. 08/009,906filed Jan. 26, 1993, now U.S. Pat. Ser. No. 5,360,702.

FIELD OF THE INVENTION

This invention relates to a photographic coating composition, to a method of stabilizing said composition and to photographic elements made therefrom.

BACKGROUND OF THE INVENTION

Photographic elements generally form images through a reaction in which a developer reduces exposed silver halide to metallic silver. The oxidized developer then often reacts with a coupler that forms or releases an image-forming dye or other photographically useful compound. However, unwanted reactions between oxidized developer and components of the photographic element can cause adverse effects, such as color contamination. For example, in a multilayer color photographic element, a different color dye image is formed in each color-sensitive layer of the element by the reaction of oxidized developer in that layer with a dye forming coupler. Migration of oxidized developer from one color-sensitive layer to another can cause unwanted dye formation in one layer as a result of exposure and development in another layer, adversely effecting color image reproduction.

In order to minimize unwanted reactions between oxidized developer and components of the photographic element, oxidized developer scavengers are used. These scavengers are incorporated in photographic elements in locations, such as interlayers, to prevent or reduce the reaction of oxidized developer with components in the element. Oxidized developer scavengers are well known in the art and are described, for example, in U.S. Pat. Nos. 4,366,236 to Takahashi, 4,447,523 to Ross et al., 4,923,787 to Harder, and 4,927,744 to Henzel et al.

Photographic elements also often contain filter dyes to absorb light from different regions of the spectrum, such as red, green, blue, ultraviolet, and infrared. These filter dyes are often required to perform the function of absorbing light during exposure of the material so as to prevent or at least inhibit light of a region of the spectrum from reaching at least one of the radiation sensitive layers of the element. Filter dyes are often employed in photographic elements as solid particle dispersions as described, for example, in U.S. Pat. Nos. 3,661,899 to Lange et al. 4,770,984 to Ailliet et al., 4,900,653 to Factor et al., 4,923,788 to Shuttleworth et al., 4,940,654 to Diehl et al., 4,948,717 to Diehl et al., 4,948,718 to Factor et al., 4,988,611 to Anderson et al., and 4,994,356 to Diehl et al.

It may be desirable for the oxidized developer scavenger and the filter dye to be contained in the same layer. In this case, they are generally applied to a photographic support in the same photographic coating composition and must be compatible with one another in the composition prior to being coated. That is to say that they should remain stable in the presence of each other during melt holding, for example, when held in a coating melt at about 45° C. for up to about 24 hours.

PROBLEM TO BE SOLVED BY THE INVENTION

A practical problem which has occurred when oxidized developer scavenger dispersions and filter dye dispersions are held together in a melt prior to coating is that the filter dye particles grow into long needles ranging from 4 to 20 μm in length. These needles result in filter plugging during coating and physical defects in the coated photographic material. This filter dye particle growth is not observed when the oxidized developer scavenger dispersion is absent in the melt.

SUMMARY OF THE INVENTION

In accordance with this invention an oxidized developer scavenger dispersion is formulated in a manner such that it does not interact with a filter dye dispersion present in the same coating composition even when held in a melt. This is achieved by using a judicious choice of organic solvent and organic solvent/scavenger ratio in preparing the oxidized developer scavenger dispersion. It has been found that particle growth of the dispersed filter dye particles is mitigated when the oxidized developer scavenger is dispersed either in a relatively small amount of a hydrophilic organic solvent or in a hydrophobic organic solvent in accordance with the following relationship:

$$.65+10.0\,A-.53\,B+.11\,B^2-0.99\,AB \leqq .0$$

wherein A is the ratio of organic solvent to oxidized developer scavenger, and B is the hydrophobicity of the organic solvent expressed as the log P (the logarithm of n-octanol/water partition coefficient described more fully below).

One aspect of this invention comprises a photographic coating composition comprising an aqueous medium containing a binder and having dispersed therein:

a) particles comprising a filter dye; and b) particles comprising an organic solvent having dispersed therein an oxidized developer scavenger;

wherein the organic solvent and the relative amounts of organic solvent and oxidized developer scavenger are selected such that the following relationship is satisfied:

$$.65+10.0\,A-.53\,B+.11\,B^2-0.99\,AB \leqq .0$$

wherein A is the weight ratio of organic solvent to oxidized developer scavenger; and B is the log P of the organic solvent.

Another aspect of this invention comprises a method of stabilizing a photographic coating comprising an aqueous medium containing a binder and having dispersed therein a filter dye and an oxidized developer scavenger which method comprises preparing the composition by dispersing in the aqueous medium:

a) particles of the filter dye; and b) particles comprising an organic solvent having dispersed therein the oxidized developer scavenger, wherein the organic solvent and the relative amounts of organic solvent and oxidized developer scavenger are selected such that the following relationship is satisfied:

$$.65+10.0\,A-.53\,B+.11\,B^2-0.99\,AB \leqq .0$$

wherein A is the weight ratio of organic solvent to oxidized developer scavenger; and B is the log P of the organic solvent.

A further aspect of this invention comprises a photographic element comprising a support having thereon at least one silver halide photographic emulsion layer and a layer, which is the same or different from said silver halide layer, comprising a binder having dispersed therein:

a) particles comprising a filter dye; and b) particles comprising an organic solvent having dispersed therein an oxidized developer scavenger; wherein the organic solvent and the relative amounts of organic solvent and oxidized developer scavenger are selected such that the following relationship is satisfied:

$$.65+10.0\ A-.53\ B+.11\ B^2-0.99\ AB \leqq .0$$

wherein A is the weight ratio of organic solvent to oxidized developer scavenger; and B is the log P of the organic solvent.

ADVANTAGEOUS EFFECT OF THE INVENTION

Utilization of a dispersion of oxidized developer scavenger in accordance with this invention provides a dispersion which can be used together with a dispersion of a filter dye in the same coating composition without undesired particle growth of the filter dye particles when the coating composition is held in a melt prior to coating.

DETAILED DESCRIPTION OF THE INVENTION

As discussed above photographic compositions are coated from a melt of the composition. Such coating melts can be held at temperatures of up to about 45° C. for up to about 24 hours. Photographic compositions can be coated using, for example, the bead or curtain coating techniques as discussed in U.S. Pat. Nos. 2,761,417 to Russell et al., 2,681,294 to Beguin, 4,525,392 to Ishizaki, 3,632,374 to Greiller, and 4,569,863 to Koepke et al., the entire disclosures of which are incorporated herein by reference.

Photographic coating compositions and elements according to the present invention contain filter dyes, such as the filter dyes disclosed in U.S. Pat. Nos. 3,661,899 to Lange et al., 4,770,984 to Ailliet et al., 4,900,653 to Factor et al., 4,923,788 to Shuttleworth et al., 4,940,654 to Diehl et al., 4,948,717 to Diehl et al., 4,948,718 to Factor et al., 4,988,611 to Anderson et al., and 4,994,356 to Diehl et al., the entire disclosures of which are incorporated hereinby reference.

Preferred filter dyes are of the formula:

$$[D-(A)_y]-X_n$$

wherein D comprises a chromophoric light-absorbing moiety, which comprises an aromatic ring if y is 0, A is an aromatic ring bonded directly or indirectly to D, X is a substituent, other than carboxy, having an ionizable proton, either on A or on an aromatic ring portion of D, having a pKa of about 4 to about 11 in a 50/50 mixture (volume basis) of ethanol and water, y is 0 to 4, n is 1 to 7 and the compound has a log P of from about 0 to about 6 when the compound is in unionized form. Such dyes are disclosed in above incorporated U.S. Pat. No. 4,940,654 to Diehl et al.

Particularly preferred are filter dyes of the formula:

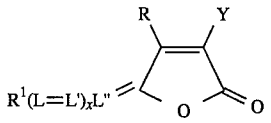

wherein R is substituted or unsubstituted alkyl or aryl, Y is an electron withdrawing group, R' is substituted or unsubstituted aryl or a substituted or unsubstituted aromatic heterocyclic nucleus, and L, L', and L" are each independently a substituted or unsubstituted methine group and x is 0 or a positive interger of from 1 to 6. Such filter dyes are disclosed in above incorporated U.S. Pat. No. 4,923,788 to Shuttleworth et al.

Preferred filter dyes are the following compounds:

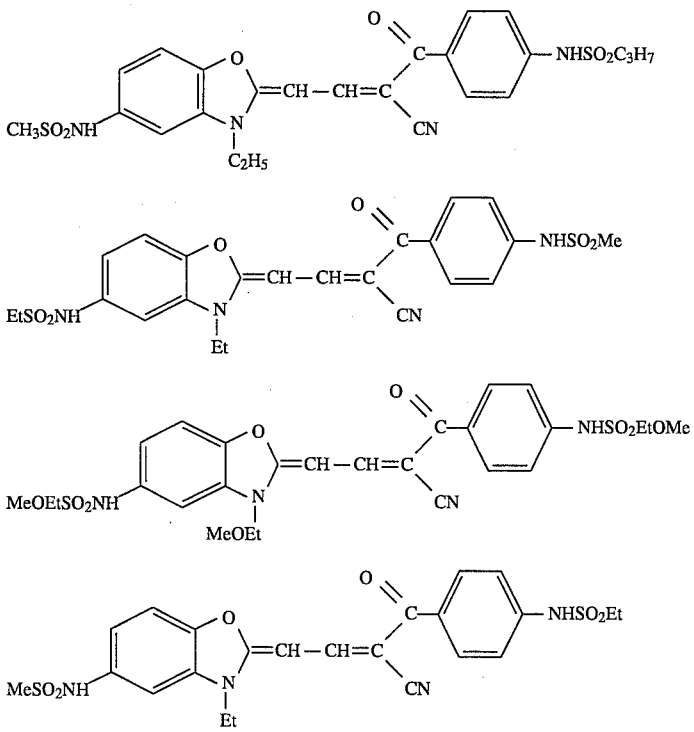

-continued
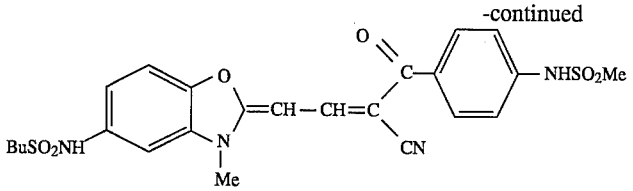
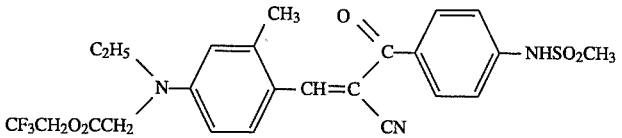
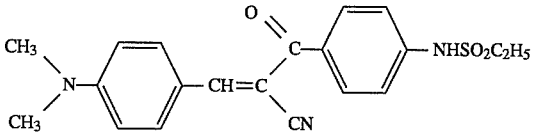
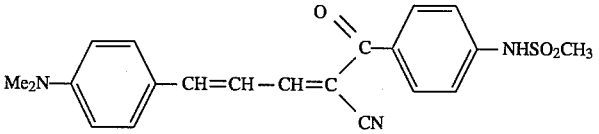
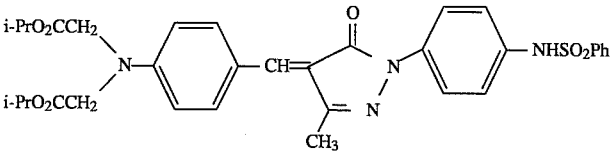
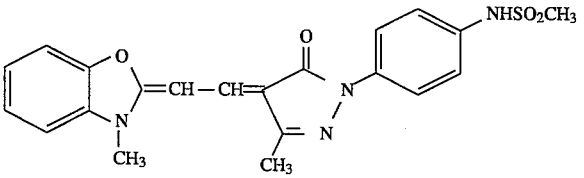
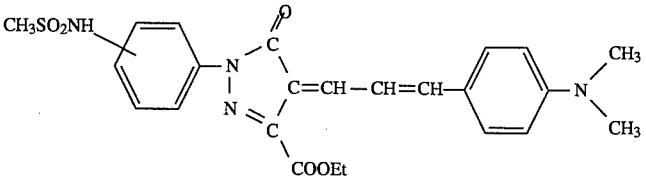
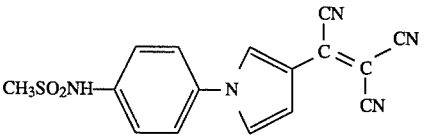
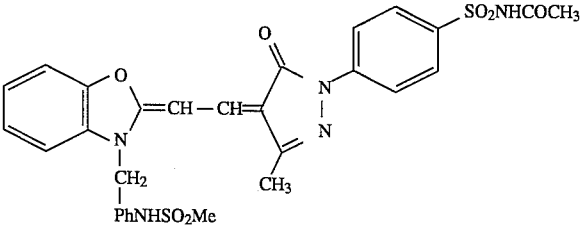

-continued
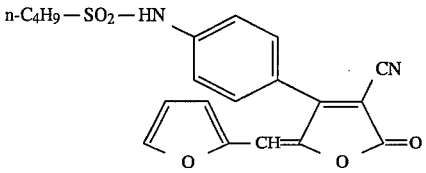
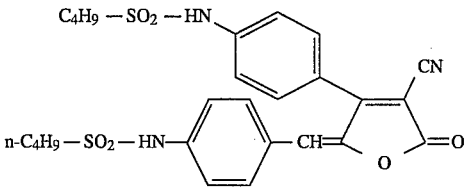
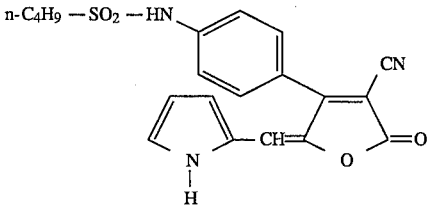
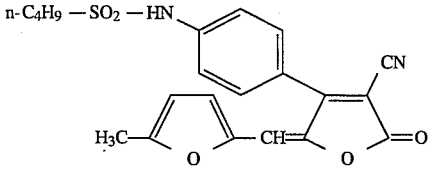
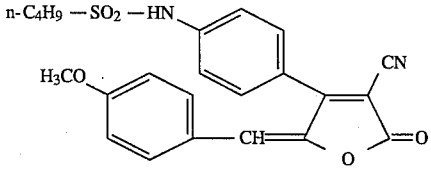
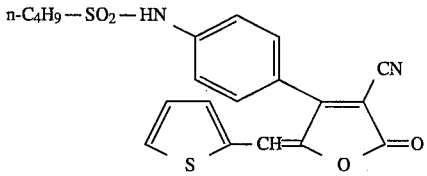
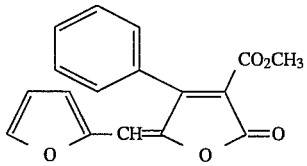
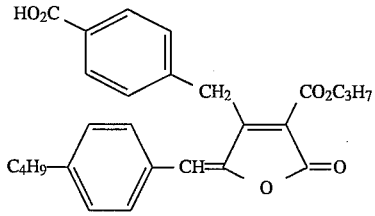

-continued
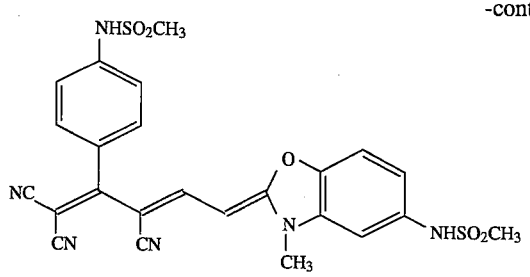
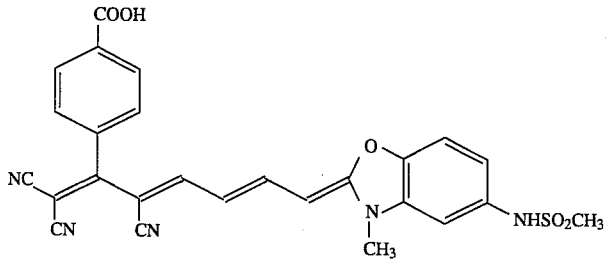
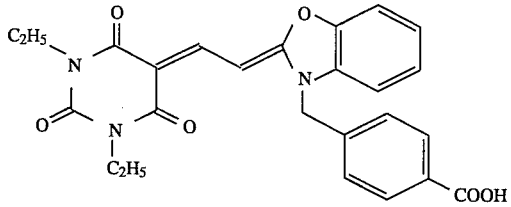
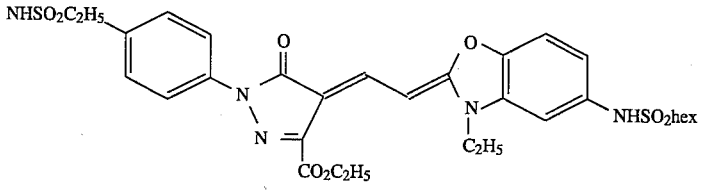
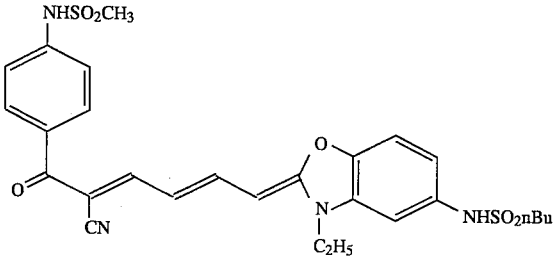
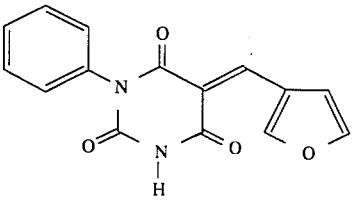
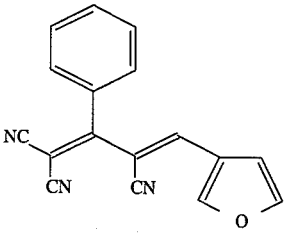

-continued

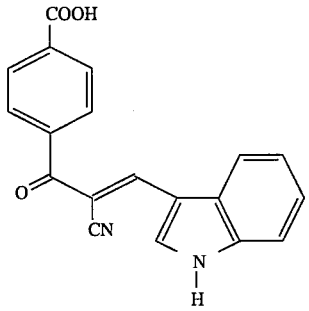

and

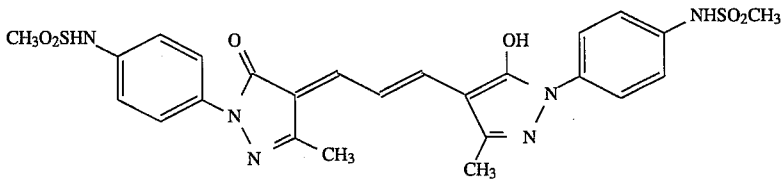

In the photographic element of this invention, the filter dyes described are useful for any of the purposes and in any of the locations in the photographic element where it would be known to one skilled in the art to use filter dyes.

In a preferred embodiment, the filter dye is dispersed in the form of a solid particle dispersion, where the small solid particles of the dye have a mean diameter on the order of about 10 μm or less and preferably about 1 μm or less. Solid particle filter dye dispersions are formed either by milling the dye in solid form until the desired particle size is reached or by precipitating the dye directly in the form of a solid particle dispersion.

In the coating composition of this invention the filter dye is dispersed in an aqueous medium containing a binder. In the photographic element of this invention, the composition has been coated onto a support and dried leaving the filter dye particles dispersed in the binder. Suitable binders include both naturally occurring and synthetic binders, such as gelatin and gelatin derivatives, polyvinyl alcohols, acrylamide polymers, polyvinylacetals, polyacrylates, and the like.

The filter dyes described are present in a layer of the photographic element in an amount to be effective as a photographic filter dye, as would be known to one skilled in the art. The filter dye is preferably present in an amount of from 1 to 2000 mg/m$^2$ and more preferably in an amount of from 25 to 500mg/m$^2$. The dye preferably provides an optical density of 0.1 to 3.0 density units at its lambda-max.

Photographic compositions and elements according to the present invention contain an oxidized developer scavenger, preferably a hydrazide oxidized developer scavenger as described in detail in U.S. Pat. No. 4,923,787 to Harder, or a disulfonamidophenol oxidized developer scavenger as described in detail in U.S. Pat. No. 4,447,523 to Ross et al., the entire disclosures of which are incorporated herein by reference. The oxidized developer scavenger compounds used in the present invention can be prepared by reactions known in the art using existing technology.

Preferred hydrazide oxidized developers have the structural formula:

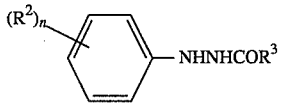

wherein $R^2$ represents an electron donating group $R^3$ represents hydrogen, alkyl, alkoxy, aryl, aryloxy, aralkyl or amino of the formula —$NHR^4$ where $R^4$ is phenyl or benzyl; with the proviso that at least one of the substituents $R^2$ and $R^3$ (a) represents a ballast group of sufficient size as to render the hydrazide compound non-diffusible in a photographic element prior to development in alkaline processing solution and (b) comprises a polar group, and n i s 0, 1, or 2.

Particularly preferred hydrazide scavengers are compounds of the formula:

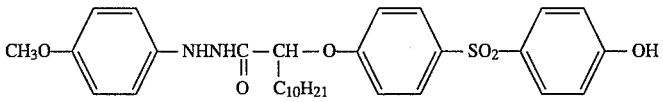

-continued
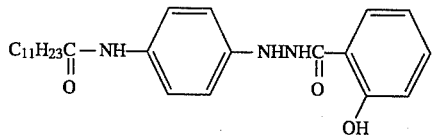
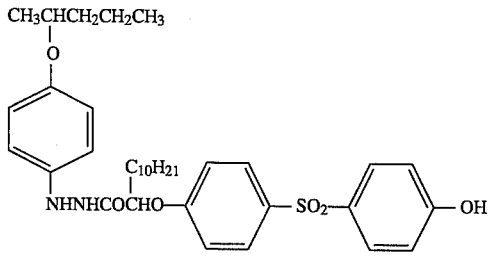
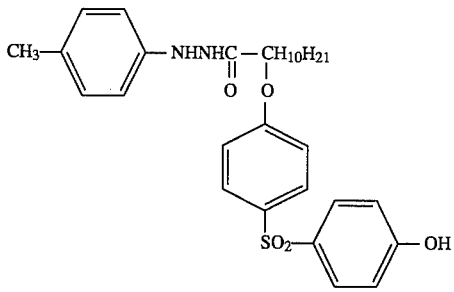
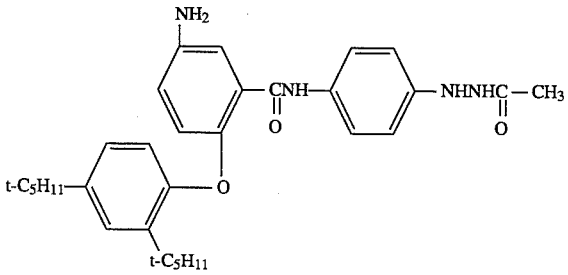
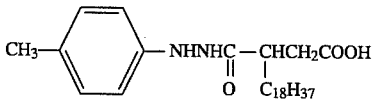
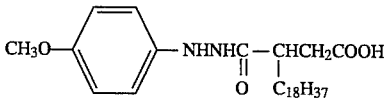
and
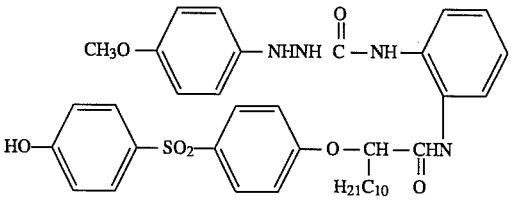
Preferred disulfonamidophenol oxidized developer scavengers have the structural formula:

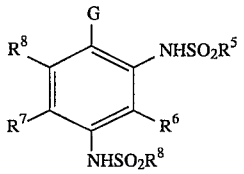

wherein G is hydroxy or an alkali labile precursor thereof; each $R^5$ is individually alkyl of 1 to 30 carbon atoms, or aryl of 6 to 30 carbon atoms or heterocyclyl of 5 to 30 atoms containing one or more ring hetero atoms selected from nitrogen, oxygen, sulfur and selenium; and $R^6$, $R^7$, and $R^8$ are each individually hydrogen, halogen, alkyl of 1 to 30 carbon atoms, aryl of 6 to 30 carbon atoms or aryloxy of 6 to 30 carbon atoms, the scavenger being of sufficient bulk so as to be non-diffusible in the alkali permeable layers of the element.

particularly preferred disulfonamidophenol scavengers are compounds of the formula:

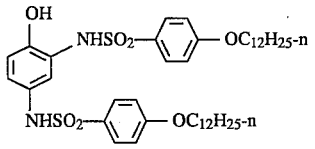

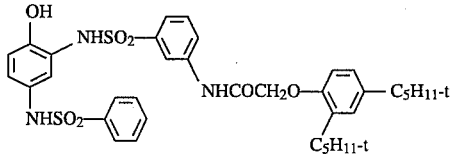

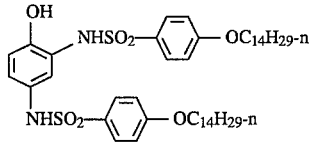

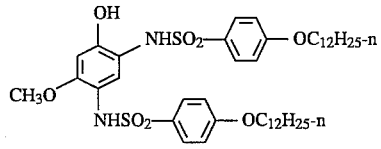

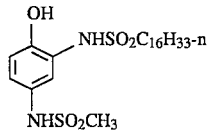

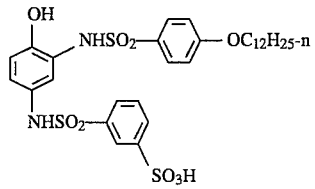

-continued

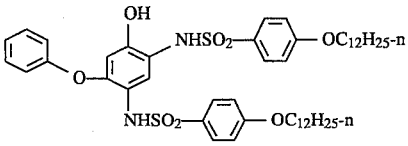

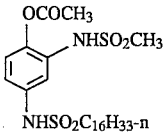

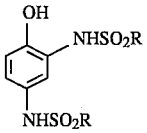

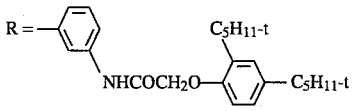

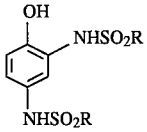

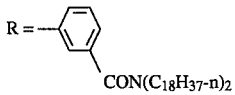

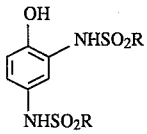

and

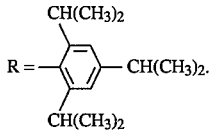

The oxidized developer scavenger is used in this invention in the ways and for the purposes that scavengers for oxidized developing agent are employed in the art.

The amount of scavenger compound employed will depend upon the particular purpose for which the scavenger is to be used and the degree of scavenging desired. Typically useful results are obtained when the scavenger is employed in an amount of between 1 and 2000 mg/m$^2$ and more preferably in an amount of from 5 to 500 mg/m$^2$.

The scavenger can be incorporated in the photographic composition and element of this invention by dissolving in the scavenger in a high boiling solvent, such as: an alkyl or aryl phosphate, phthalate ester, carbonamide, phenol, alcohol, alkyl or aryl ester or the like. The high boiling organic solvent is used in an amount relative to the oxidized developer scavenger such that the relationship set forth above is satisfied. In determining the amount of solvent to be used, the hydrophobicity of the solvent must be considered. If the solvent is relatively hydrophilic, then less of the solvent is used. If, on the other hand, the solvent is relatively hydrophobic, more of the solvent can be used. A measure of the hydrophobicity of the solvent is the logarithm of the partition coefficient of the compound in a system of n-octanol and water and can be calculated in the manner described in an article by A. Leo, P. Y. C. Jow, C. Silipo and C. Hansch, Journal of Medicinal Chemistry, Vol. 18, No. 9, pp. 865–868, 1975. This logarithm is referred to herein as log P.

As discussed above, the melt crystallization of the composition is mitigated when the relative amount of solvent used satisfies the relationship $$.65+10.0\ A-.53\ B+.11\ B^2-.99\ AB \leqq .0.$$

wherein A is the ratio of organic solvent to oxidized developer scavenger, and B is the hydrophobicity of the organic solvent expressed as the log P (the logarithm of n-octanol/water partition coefficient described more fully below). This relationship holds for compositions in which the degree of melt crystallization (that is, the degree to which the filter dye particles grow into needles when the composition is held in a melt) is less than or equal to 4.0 on a scale of 0 to 10 as described more fully in Example 3, below. Compositions for which this relationship is not satisfied exhibit undesirable particle growth of the filter dye particles when the composition is held in the melt.

A low-boiling and/or partially water soluble auxiliary solvent, such as ethyl acetate, may also be used to help dissolve the scavenger in the oil phase which can be subsequently removed by evaporation, washing, or dialysis techniques which are well known in the art.

The oxidized developer scavenger dispersion particle size may range from 0.01 to 50.0 μm in diameter.

The photographic element comprises a support having thereon one or more radiation-sensitive layers, usually silver halide emulsion layers, along with a number of other layers known to those skilled in the art. The filter dye/oxidized developer composition can be incorporated in a silver halide emulsion layer of the element or in a separate layer, such as an interlayer, an undercoat layer or an overcoat layer. The layer is preferably an interlayer between silver halide emulsion layers.

The following examples illustrate the preparation of photographic compositions and elements of the invention. The compounds used in the examples have the following structures:

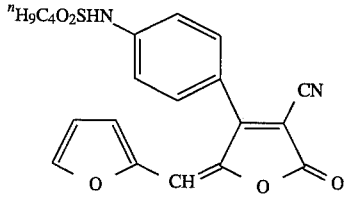

Compound I

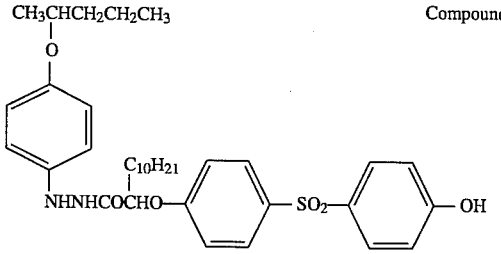

Compound II

-continued

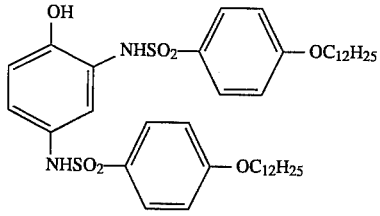

Compound III

EXAMPLE 1

A solid particle dispersion of the filter dye compound I was prepared by combining 20.0 g of filter dye, 0.20 g of Triton X200E ®, 79.8 g distilled water and 250 ml of 2 mm zirconia beads in a 450 ml bottle, and ball-milled for 14 days at 97 rpm. The resulting dispersion was mixed with gelatin and water to yield a dispersion having 5% dye and 7% gelatin and mean particle size of approximately 0.15 μm, called Dispersion A.

An oxidized developer scavenger dispersion was prepared by dissolving 12.0 g of compound II in 12.0 g of di-n-butylphthalate and 24.0 g of ethyl acetate at 60° C., then combining the resulting dispersion with an aqueous phase consisting of 16.0 g gelatin, 6.0 g of a 10% solution of Alkanol XC ® (a surfactant commercially available from Du Pont) and 130.0 g distilled water through a colloid mill 5 times followed by evaporation of the ethyl acetate using rotary evaporator and replacement with distilled water to yield a dispersion having 6.0% scavenger and 8.0% gelatin and a mean particle size of approximately 0.25 μm, called Dispersion B.

A coating melt was then prepared by combining 3.09 g of Dispersion A, 1.55 g of Dispersion B, 6.40 g of gelatin and 88.96 g of distilled water. The melt was then held for hours at 45° C. and evaluated by optical microscopy at 200X magnification. Many large (4–20 μm) needle-shaped crystals (10–50 per field) were observed.

Oxidized developer scavenger dispersions C through G were prepared and evaluated in the same manner as Dispersion B except that alternative organic solvents were used in place of di-n-butylphthalate. The results are summarized in the Table I:

TABLE I

Effect of Scavenger Dispersion Organic Solvent on Yellow Filter Dye Melt Hold Stability

| Dispersion ID | Organic Solvent | Microscopic Analysis Following 24 hrs at 45° C. |
|---|---|---|
| B | di-n-butylphthalate (log P = 4.69) | Many Large Needles (4–20 μm) |
| C | Diethyllauramide (log P = 4.99) | Many Large Needles (4–20 μm) |
| D | tricresylphosphate (log P = 6.58) | Many Large Needles (4–20 μm) |
| E | 1,4-cyclohexylene dimethylene bis (2-ethylhexanoate) (log P = 8.14) | No crystallization |
| F | didecylphthalate (log P = 11.04) | " |
| G | didodecylphthalate (log P = 13.16) | " |

The results clearly show that the crystallization problem is eliminated when more hydrophobic organic solvents are used in the oxidized developer scavenger dispersion.

EXAMPLE 2

Dispersion H was prepared in the same manner as Dispersion C in Example 1, except that 6.0 g of diethyllauramide and 136.0g of distilled water was used. Dispersion I was also prepared in the same manner as Dispersion C in Example I, except that 3.0 g of diethyllauramide and 139.0 g of distilled water were used. These dispersions were also evaluated in coating melts as described in Example 1. The results are summarized in Table II below:

TABLE II

Effect of Scavenger Dispersion Organic Solvent Level on Yellow Filter Dye Melt Hold Stability

| Dispersion ID | Diethyllauramide/ Scavenger Ratio | Microscopic Analysis Following 24 hr at 45° C. |
|---|---|---|
| C | 1.0 | Many Large Needles (4–20 μm) |
| H | 0.5 | Few large needles |
| I | 0.25 | No crystallization |

These results indicate that the crystallization problem is also eliminated by employing low levels of a more hydrophilic organic solvent such as diethyllauramide (log P=4.99).

EXAMPLE 3

A series of oxidized developer scavenger dispersions were prepared as described in Example 1 using six different organic solvents, which varied widely in their hydrophobicities. Each organic solvent was employed at three levels of solvent/scavenger ratios as described in Table III. Each dispersion was used to prepare a coating melt which was evaluated as described in Example 1. In this case, each melt was qualitatively rated {for degree of crystallization} on a scale of 1 to 10. A rating of 1 indicates no crystallization While a rating of 10 indicates the presence of hundreds of large needles per microscopic field. These results are summarized in Table III.

TABLE III

Effect of Scavenger Dispersion Organic Solvent on Yellow Filter Dye Melt Hold Stability

| Dispersion ID | Organic Solvent | Solvent/Scavenger Ratio | Rating |
|---|---|---|---|
| 1 | n-butlyacetanilide (log P = 2.29) | 0.25 | 5 |
| 2 | n-butlyacetanilide (log P = 2.29) | 0.5 | 10 |
| 3 | n-butlyacetanilide (log P = 2.29) | 1.0 | 10 |
| 4 | diethyllauramide (log P = 4.99) | 0.25 | 2 |
| 5 | diethyllauramide (log P = 4.99) | 0.5 | 3 |
| 6 | diethyllauramide (log P = 4.99) | 1.0 | 7 |
| 7 | tricresylphosphate (log P = 6.58) | 0.25 | 2 |
| 8 | tricresylphosphate (log P = 6.58) | 0.5 | 3 |
| 9 | tricresylphosphate (log P = 6.58) | 1.0 | 7 |
| 10 | p = dodecylphenol (log P = 7.94) | 0.25 | 2 |
| 11 | p = dodecylphenol (log P = 7.94) | 0.5 | 3 |
| 12 | p = dodecylphenol (log P = 7.94) | 1.0 | 2 |
| 13 | tri-(2-ethylhexyl)phosphate (log P = 9.49 | 0.25 | 2 |
| 14 | tri-(2-ethylhexyl)phosphate (log P = 9.49 | 0.5 | 2 |
| 15 | tri-(2-ethylhexyl)phosphate (log P = 9.49 | 1.0 | 2 |
| 16 | didecylphthalate (log P = 11.04) | 0.25 | 3 |
| 17 | didecylphthalate (log P = 11.04) | 0.5 | 2 |
| 18 | didecylphthalate (log P = 11.04) | 1.0 | 2 |

These data were analyzed using a standard multiple linear regression technique (the SAS general linear model procedure—SAS Institute, Cary, N.C., USA) to obtain the following empirical model:

$$Y=.65+10.A-.53\ B+.11\ B^2-0.99\ AB$$

where Y is the degree of crystallization (on a scale of 1 to 10), A is the ratio of organic solvent to oxidized developer, and B is the organic solvent log P (logarithm of n-octanol/water partition coefficient). Manufacturing experience indicated that the degree of crystallization should be considered acceptable if Y is less than or equal to 4.0. The model indicates that the crystallization problem can be alleviated either by using more hydrophobic organic solvents or lower levels of more hydrophilic organic solvents in the oxidized developer scavenger dispersion. The model defines the level of hydrophilic solvent required to achieve an acceptable melt crystallization position.

EXAMPLE 4

An oxidized developer scavenger dispersion was prepared by dissolving 6.0 g of Compound III in 6.0 g of diethyllauramide and 12.0 g of ethyl acetate at 70° C., then combined with an aqueous phase consisting of 8.0 g gelatin, 6.0 g of a 10% solution of Alkanol-XC and 54.0 g of distilled water. This mixture was then passed through a colloid mill five times, then the ethyl acetate was removed using a rotary evaporator. All mass lost was replaced with water to yield a dispersion having 6.0% scavenger, 8.0% gelatin and a mean particle size of approximately 0.15 mm called Dispersion J. Dispersion K was prepared in a similar manner except that 1.5 g of diethyllauramide and 58.5 g of distilled water were used.

Coating melts were then prepared and evaluated as described in Example 1. The melt containing Dispersion J (prior art) exhibited several large (4–20 m) needle-shaped crystals (5–20 per field) while the melt containing Dispersion K (this invention) showed no crystallization. This result demonstrates that the melt crystallization problem is observed with disulfonamidophenol oxidized developer scavengers and solved by the formulation criteria set forth in the empirical model of Example 3.

The invention has been described in detail with particular reference to preferred embodiments thereof, but it is to be understood that variations and modifications can be effected within the spirit and scope of the invention.

What is claimed is:

1. A photographic coating composition comprising an aqueous medium containing a binder and having dispersed therein:

a) particles comprising a filter dye; and b) particles comprising an organic solvent having dispersed therein an oxidized developer scavenger;

wherein the organic solvent and the relative amounts of organic solvent and oxidized developer scavenger are selected such that the following relationship is satisfied:

$$.65+10.0\ A-.53\ B+.11\ B^2-0.99\ AB \leqq .0$$

wherein A is the weight ratio of organic solvent to oxidized developer scavenger; and B is the log P of the organic solvent, where log P is the logarithm of the n-octanol/water partition coefficient of the organic solvent.

2. A photographic coating composition according to claim 1, wherein the filter dye has the formula:

$$[D-(A)_y)]-X_n$$

wherein D comprises a chromophoric light-absorbing moiety, which comprises an aromatic ring if y is 0, A is an aromatic ring bonded directly or indirectly to D, X is a substituent, other than carboxy, having an ionizable proton, either on A or on an aromatic ring portion of D, having a pKa of about 4 to 11 in a 50/50 mixture (volume basis) of ethanol and water, y is 0 to 4, n is 1 to 7 and the compound has a log partition coefficient of from about 0 to 6 when the compound is in unionized form.

3. A photographic coating composition according to claim 1, wherein the filter dye has the formula:

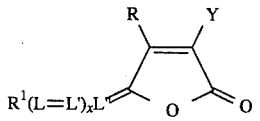

wherein R is alkyl or aryl, Y is an electron withdrawing group, and $R^1$ is aryl or an aromatic heterocyclic nucleus, L, L', and L" are each independently a methine group, and x is 0 or a positive integer from 1 to 6.

4. A photographic coating composition according to claim 1, wherein the oxidized developer scavenger compound is selected from hydrazide oxidized developer scavengers and disulfonamidophenol oxidized developer scavengers.

5. A photographic coating composition according to claim 4, wherein the oxidized developer scavenger compound is a hydrazide having the structural formula:

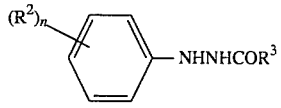

wherein $R^2$ represents an electron donating group $R^3$ represents hydrogen, alkyl, alkoxy, aryl, aryloxy, aralkyl or amino of the formula —$NHR^4$ where $R^4$ phenyl or benzyl; with the proviso that at least one of the substituents $R^2$ and $R^3$ (a) represents a ballast group of sufficient size as to render the hydrazide compound non-diffusible in a photographic element prior to development in alkaline processing solution and (b) comprises a polar group, and n is 0, 1, or 2.

6. A photographic coating composition according to claim 4 wherein the oxidized developer scavenger compound is a 2,4 disulfonamidophenol having the structural formula:

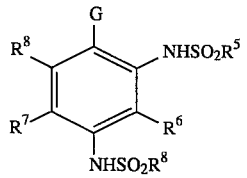

wherein G is hydroxy or an alkali labile precursor thereof; each $R^5$ is individually alkyl of 1 to 30 carbon atoms, or aryl of 6 to 30 carbon atoms or heterocyclyl of 5 to 30 atoms containing one or more ring hetero atoms selected from nitrogen, oxygen, sulfur and selenium; and $R^6$, $R^7$, and $R^8$ are each individually hydrogen, halogen, alkyl of 1 to 30 carbon atoms, aryl of 6 to 30 carbon atoms or aryloxy of 6 to 30 carbon atoms, the scavenger being of sufficient bulk so as to be non-diffusible in the alkali permeable layers of the element.

7. A photographic coating composition according to claim 1, wherein the filter dye is in the form of a solid particle dispersion.

8. A method of stabilizing a photographic coating comprising an aqueous medium containing a binder and having dispersed therein a filter dye and an oxidized developer scavenger which method comprises preparing the composition by dispersing in the aqueous medium:

a) particles of the filter dye; and b) particles comprising an organic solvent having dispersed therein the oxidized developer scavenger;

wherein the organic solvent and the relative amounts of organic solvent and oxidized developer scavenger are selected such that the following relationship is satisfied:

$$.65+10.0\ A-.53\ B+.11\ B^2-0.99\ AB \leqq .0$$

wherein A is the weight ratio of organic solvent to oxidized developer scavenger; and B is the log P of the organic solvent, where log P is the logarithm of the n-octanol/water partition coefficient of the organic solvent.

9. A method of stabilizing a photographic coating according to claim 8, wherein the filter dye has the formula:

$$[D-(A)_y)]-X_n$$

wherein D comprises a chromophoric light-absorbing moiety, which comprises an aromatic ring if y is 0, A is an aromatic ring bonded directly or indirectly to D, X is a substituent, other than carboxy, having an ionizable proton, either on A or on an aromatic ring portion of D, having a pKa of about 4 to 11 in a 50/50 mixture (volume basis) of ethanol and water, y is 0 to 4, n is 1 to 7 and the compound has a log partition coefficient of from about 0 to 6 when the compound is in unionized form.

10. A method of stabilizing a photographic coating according to claim 8, wherein the filter dye has the formula:

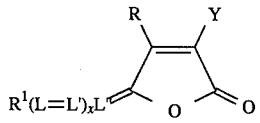

wherein R is alkyl or aryl, Y is an electron withdrawing group, and $R^1$ is aryl or an aromatic heterocyclic nucleus, L, L', and L" are each independently a methine group, and x is 0 or a positive integer from 1 to 6.

11. A method of stabilizing a photographic coating according to claim 8, wherein the oxidized developer scavenger compound is selected from hydrazide oxidized developer scavengers and disulfonamidophenol oxidized developer scavengers.

12. A method of stabilizing a photographic coating according to claim 11, wherein the oxidized developer scavenger compound is a hydrazide having the structural formula:

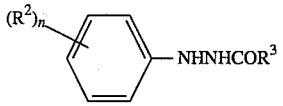

wherein $R^2$ represents an electron donating group $R^3$ represents hydrogen, alkyl, alkoxy, aryl, aryloxy, aralkyl or amino of the formula —$NHR^4$ where $R^4$ is phenyl or benzyl; with the proviso that at least one of the substituents $R^2$ and $R^3$ (a) represents a ballast group of sufficient size as to render the hydrazide compound non-diffusible in a photographic element prior to development in alkaline processing solution and (b) comprises a polar group, and n is 0, 1, or 2.

13. A method of stabilizing a photographic coating according to claim 11 wherein the oxidized developer scavenger compound is a 2,4 disulfonamidophenol having the structural formula:

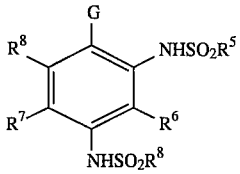

wherein G is hydroxy or an alkali labile precursor thereof; each $R^5$ is individually alkyl of 1 to 30 carbon atoms, or aryl of 6 to 30 carbon atoms or heterocyclyl of 5 to 30 atoms containing one or more ring hetero atoms selected from nitrogen, oxygen, sulfur and selenium; and $R^6$, $R^7$, and $R^8$ are each individually hydrogen, halogen, alkyl of 1 to 30 carbon atoms, aryl of 6 to 30 carbon atoms or aryloxy of 6 to 30 carbon atoms, the scavenger being of sufficient bulk so as to be non-diffusible in the alkali permeable layers of the element.

14. A method of stabilizing a photographic coating according to claim 8, wherein the filter dye is in the form of a solid particle dispersion.

* * * * *

UNITED STATES PATENT AND TRADEMARK OFFICE

CERTIFICATE OF CORRECTION

PATENT NO. : 5,457,014
DATED : October 10, 1995
INVENTOR(S) : Paul L. Zengerle, et al It is certified that error appears in the above-indentified patent and that said Letters Patent is hereby corrected as shown below:

Column 2, line 22, delete ".65+10.0 A-.53 B+.11 $B^2$-0.99 AB≤.0" and insert therefor --6.65 + 10.0 A - 1.53 B + 0.11 $B^2$ - 0.99 AB ≤ 4.0--.

Column 2, line 38, delete ".65+10.0 A-.53 B+.11 $B^2$-0.99 AB≤.0" and insert therefor --6.65 + 10.0 A - 1.53 B + 0.11 $B^2$ - 0.99 AB ≤ 4.0--.

Column 2, line 56, delete ".65+10.0 A-.53 B+.11 $B^2$-0.99 AB≤.0" and insert therefor --6.65 + 10.0 A - 1.53 B + 0.11 $B^2$ - 0.99 AB ≤ 4.0--.

Column 3, line 6, delete ".65+10.0 A-.53 B+.11 $B^2$-0.99 AB≤.0" and insert therefor --6.65 + 10.0 A - 1.53 B + 0.11 $B^2$ - 0.99 AB ≤ 4.0--.

Column 17, line 13, delete ".65+10.0 A-.53 B+.11 $B^2$-.99 AB≤.0" and insert therefor --6.65 + 10.0 A - 1.53 B + 0.11 $B^2$ - 0.99 AB ≤ 4.0--.

Column 21, line 15, delete ".65+10.0 A-.53 B+.11 $B^2$-0.99 AB≤.0" and insert therefor --6.65 + 10.0 A - 1.53 B + 0.11 $B^2$ - 0.99 AB ≤ 4.0--.

UNITED STATES PATENT AND TRADEMARK OFFICE

CERTIFICATE OF CORRECTION

PATENT NO. : 5,457,014 Page 2 of 2

DATED : October 10, 1995

INVENTOR(S) : Paul L. Zengerle, et al.

It is certified that error appears in the above-indentified patent and that said Letters Patent is hereby corrected as shown below:

Column 22, line 36, delete ".65+10.0 A-.53 B+.11 $B^2$-0.99 AB≤.0" and insert therefor --6.65 + 10.0 A - 1.53 B + 0.11 $B^2$ - 0.99 AB ≤ 4.0--.

Signed and Sealed this

Second Day of April, 1996

Bruce Lehman

*Attest:*

BRUCE LEHMAN

*Attesting Officer*

*Commissioner of Patents and Trademarks*